US005404285A

United States Patent [19]

Schonbek

[11] Patent Number: 5,404,285

[45] Date of Patent: Apr. 4, 1995

[54] CHANDELIER WITH INTERLOCKING MODULAR GLASSWARE

[75] Inventor: Arnold Schonbek, Plattsburgh, N.Y.

[73] Assignee: Schonbek Worldwide Lighting Inc., Plattsburgh, N.Y.

[21] Appl. No.: 954,435

[22] Filed: Sep. 30, 1992

Related U.S. Application Data

[63] Continuation of Ser. No. 725,193, Jul. 3, 1991, abandoned.

[51] Int. Cl.[6] ..... F21V 5/06

[52] U.S. Cl. ..... 362/363; 362/332; 362/806; D26/135

[58] Field of Search ..... 362/363, 374, 375, 332, 362/806, 801; D26/128, 130, 131, 132, 133, 134, 135, 136, 149, 151

[56] References Cited

U.S. PATENT DOCUMENTS

| | | | |
|---|---|---|---|
| 1,481,719 | 1/1924 | Lui | 362/363 |
| 4,091,444 | 5/1978 | Mori | 362/374 |
| 4,425,602 | 1/1984 | Lansing | 362/363 |
| 4,924,367 | 5/1990 | Hodges et al. | 362/363 |

FOREIGN PATENT DOCUMENTS

| | | | |
|---|---|---|---|
| 24757 | 10/1909 | Germany | 362/315 |
| 630977 | 10/1949 | Germany | 362/363 |
| 1229195 | 4/1971 | Germany | 362/405 |
| 1290583 | 9/1972 | Germany | 362/363 |

OTHER PUBLICATIONS

Crystal Clear Lighting, Crystal Clear Galleries Brochure, Product CH119-05 alleged by a third party to be on sale before Jul. 3, 1990.

Bibi Continental Corp., Catalog #85, pp. 69-73, 1985.

Crystal Clear Lighting, Catalog, p. 11, products alleged by a third party to be on sale before Jul. 3, 1990.

Imperlite, Catalog, one page, 1986.

Miniluce, Catalog, two pages, 1989.

Wilshire, Catalog, pp. 14-15, products alleged by a third party to be on sale before Jul. 3, 1990.

Product specification and picture for glass ornament (Scatola Anyuse) from Cristalleria Artistica La Piana, Royal Crystal Rock.

Product specification and picture for glass ornament (Scatola Cuba) from Cristalleria Artistica La Piana, Royal Crystal Rock.

*Primary Examiner*—Ira S. Lazarus
*Assistant Examiner*—Y. Quach
*Attorney, Agent, or Firm*—Wolf, Greenfield & Sacks

[57] ABSTRACT

The invention provides a chandelier having rod-mounted glass ornaments. The ornaments have decorative patterns and rims constructed and arranged to mate in a face-to-face relationship when the ornaments are positioned upon the rod in the manner such that the decorative patterns are secured in predetermined alignment. The ornaments may be constructed so that identical ornaments mate with one another. Also, sets of mating glass ornaments are provided for providing multiple combinations of decorative arrangements.

34 Claims, 11 Drawing Sheets

CHANDELIER WITH INTERLOCKING MODULAR GLASSWARE

This application is a continuation of application Ser. No. 07/725,193, filed Jul. 3, 1991, now abandoned.

FIELD OF THE INVENTION

This invention relates to chandeliers carrying rod-mounted glass ornaments.

BACKGROUND OF THE INVENTION

Chandelier rod-mounted glass ornaments typically have highly decorative patterns, the variability and complexity of which are limited only by the expense of manufacture. To speed the manufacturing process and reduce expense, these ornaments may be formed from molded glass instead of cut glass, whereby the decorative pattern is molded directly into the outer surface of the ornament. However, when such ornaments take the form of urns and the like (spheroidal shapes), they must be manufactured from two different pieces. In the prior art, the two molded pieces when mounted on the rod of a chandelier are constructed such that they are free to rotate with respect to one another about the rod, and the appearance of a single piece of glass is compromised in that the molded decorative patterns on the two pieces do not necessarily align. Because of this, the two pieces typically have been formed with wholly unrelated patterns to eliminate the appearance of misalignment. Another solution to the problem has been to downplay or eliminate pattern details at the interface between the two pieces so as to reduce the unpleasant appearance created by patterns that otherwise might misalign.

SUMMARY OF THE INVENTION

The invention overcomes these and other problems of the prior art by providing pairs of mating rod-mounted glass ornaments that are constructed and arranged to join one another only in predetermined-alignment, whereby a decorative pattern of a first ornament is secured in predetermined alignment with a decorative pattern of a second ornament. The ornaments have rims constructed and arranged to mate in face-to-face relationship when each ornament is positioned upon a rod, and preferably the rims are secured to one another by interengaging formations whereby slidable misalignment of the first ornament with respect to the second ornament is prevented. The interengaging formations may be constructed and positioned with respect to the decorative patterns so as to optically obscure their presence.

According to another aspect of the invention, sets of glass ornaments for forming multiple combinations and multiple decorative arrangements are provided. Preferably, a first ornament and a second ornament are constructed and arranged to mate in predetermined alignment to form a first decorative combination, and the first glass ornament and a third glass ornament also are constructed and arranged to mate in predetermined alignment to form a second decorative combination. Preferably, the ornaments are secured against misalignment by rims having interengaging formations. Most preferably, these interengaging formations are projections and indentations forming a geometric pattern having an axis of symmetry, the projections and indentations being the respective geometric complement of each other about the axis of symmetry. This permits any one of the glass ornaments to be secured in predetermined alignment with an identical ornament, and increases the number of potential decorative combinations possible for a set of glass ornaments. This aspect of the invention thus facilitates the manufacture of a variety of decorative combinations from a limited number of molded glass pieces, while at the same time maintaining a high level of precision in the fit and alignment of the various ornaments with one another.

It is among the objects of the invention to provide a two piece decorative unit that has the appearance of a single piece carrying a single overall pattern.

Another object of the invention is to facilitate the manufacturing of a variety of ornament decorative arrangements.

These and other objects will become more apparent with reference to the following description of the preferred embodiments.

Detailed Description of the Preferred Embodiments

The invention in one important aspect provides a pair of rod-mounted glass ornaments that may be secured to one another in predetermined alignment so that the overall appearance of the combined ornaments is that of a single piece of glass with a single decorative design. This is achieved in a preferred embodiment by forming the ornaments with mating rims including interengaging formations that align and mechanically secure the ornaments against misalignment to one another.

Rod-mounted glass ornaments typically are carried by a rod, post or other mandrel component of a chandelier framework. The ornaments define openings that are adapted to receive the rod. Most often, the openings are located along a central axis defined by the ornament. Any type of glass or crystal, with or without lead, preferably molded, may be employed. The color of the ornaments may be transparent, tinted or opaque. Other substitutes such as certain plastics known to those of ordinary skill in the art also are intended to be covered as equivalents.

Figure 1:
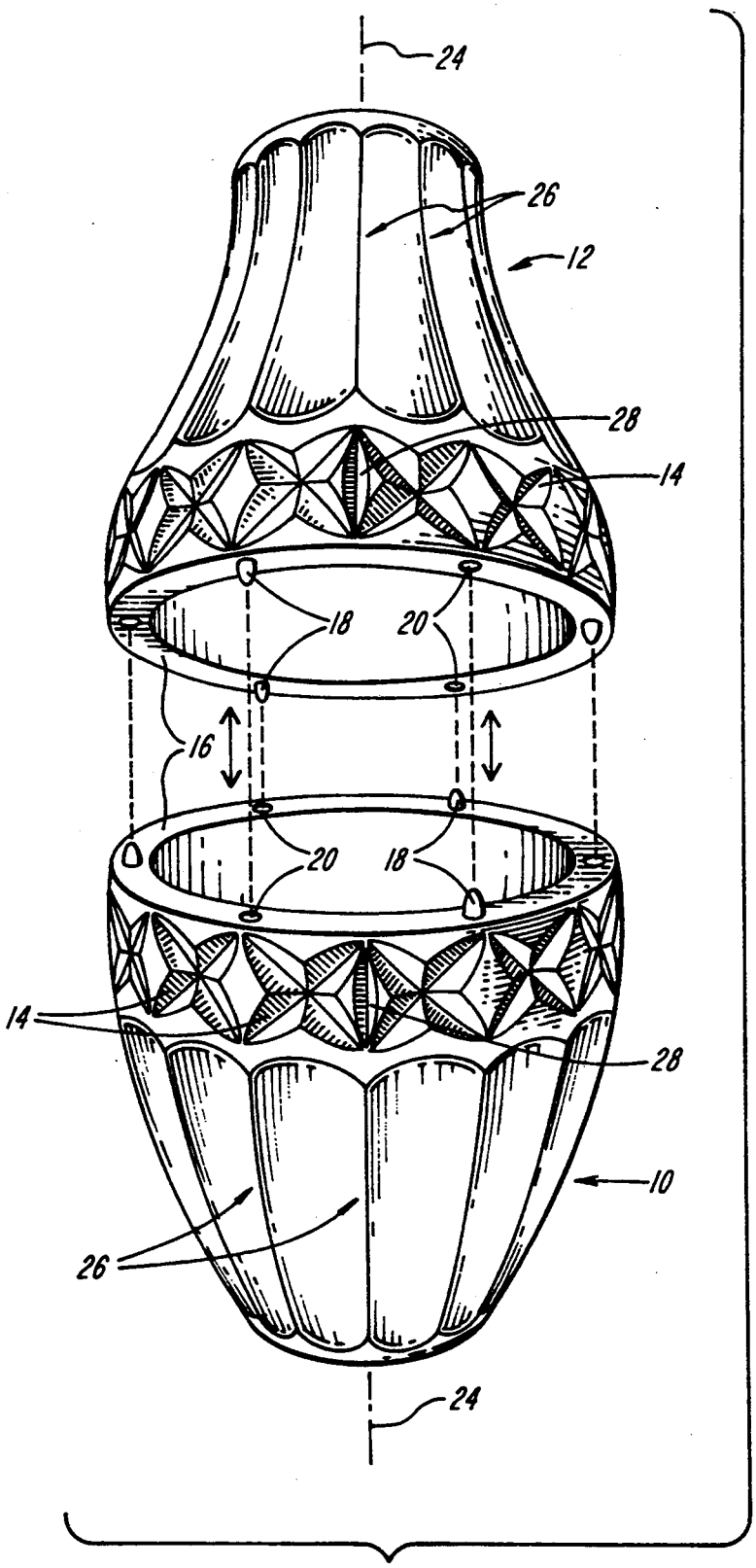
FIG. 1 is a perspective view of a two-piece glass combination having interengaging formations aligned, but separated from one another axially.

FIG. 1 is a perspective view of a pair of glass ornaments, first urn body 10, and second urn body 12, having decorative patterns aligned but axially separated to permit a viewing of the interengaging formations. The urn bodies 10, 12 have decorative patterns which are formed by their surface contour, shape and/or coloration. In typical designs, the patterns are formed as shapes molded into the surface of the glass and including repeating elements that are substantially identical and evenly spaced, such as stars 14 of urn bodies 10, 12. Such regular and repeating patterns on one ornament may be aligned with that of another ornament to result in an overall appearance of a single piece of glass witch an integral, continuous design. It should be understood, however, that the patterns need not be regular and repeating to obtain the decorative advantages produced by alignment. Thus, alignment means only that the pattern of one ornament is aligned with the pattern of another in a predetermined manner to provide a selected, combined overall pattern and appearance, i.e. predetermined alignment.

The urn bodies 10, 12 have rims 16 which are adapted to mate in face-to-face relationship when the urn bodies are brought into mating relationship. While the rims may take on a variety of surface configurations, preferably the rims are substantially planar and are oriented substantially transverse to the rod axis. Most preferably, the outer perimeters (the polygon, circle or elipse defined by the radially outwardmost edge of the rims) are substantially congruent. In this manner, when the ornaments are mated with one another, one substantially continuous outer surface of the pair of ornaments is provided and the appearance of a single piece of glass is enhanced.

To obtain the appearance of a single, overall pattern and a single piece of glass, it is important that the decorative patterns of the two mating ornaments be secured to one another against misalignment due to handling, cleaning, jarring or the like. This is achieved by providing the mating ornaments with interengaging formations. These formations are constructed and arranged both to cause the rims to be positioned in face-to-face relationship with the patterns of the mating ornaments aligned and to mechanically secure the ornaments in this predetermined alignment, preventing movement in any direction other than axially away from one another. Thus, the formations act to prevent the rotation of the ornaments with respect to one another as well as any movement of the ornaments sideways out of axial alignment.

In the embodiment depicted in FIG. 1, the interengaging formations are projections 18 and indentations 20. The projections are small projecting nipples centered widthwise on the rim. The indentations 20 are wells also centered on the rim that are large enough to accommodate the projections 18 with relatively little side to side play. The projections and indentations of the urn body 10 are positioned relative to the projections and indentations of urn body 12 such that the projections are received in the indentations when the patterns are aligned and the rims are brought into face-to-face contact with one another.

In a conventional ornament design having no interengaging formations between pieces, the wall thickness, in the region of the rims, typically is sized no larger than approximately 3/16 of an inch. However, in preferred designs according to this invention in which interengaging formations are positioned upon each rim, the rim thickness preferably is somewhat greater than 3/16 of an inch, usually about ¼" thick, in order to accommodate the indentations and protrusions without breakage under normal loading of the ornaments. Such loading preferably is contemplated to include handling, that encountered during installation and cleaning of the chandelier.

For a glass formed with 24% lead and having a rim of about 0.3", it has been found that an indentation of approximately 3/16" diameter and a protrusion of ⅛" diameter, having a height of approximately 3/32" forms a sufficiently strong set of interengaging formations, according to the geometric pattern depicted in FIG. 1, to ensure sufficient strength under normal loading conditions.

It should be noted that the protrusions are somewhat smaller in diameter than the corresponding indentations. Since the ornaments are preferably molded, approximately 1/16" variation in diameters between interengaging structures was provided in order to ensure that any size fluctuations resulting from material flow during molding did not alter the size of the formations sufficiently to cause one interengaging formation to interfere with the other. Such interference could prevent a face-to-face mating of rims during assembly.

Figure 2:
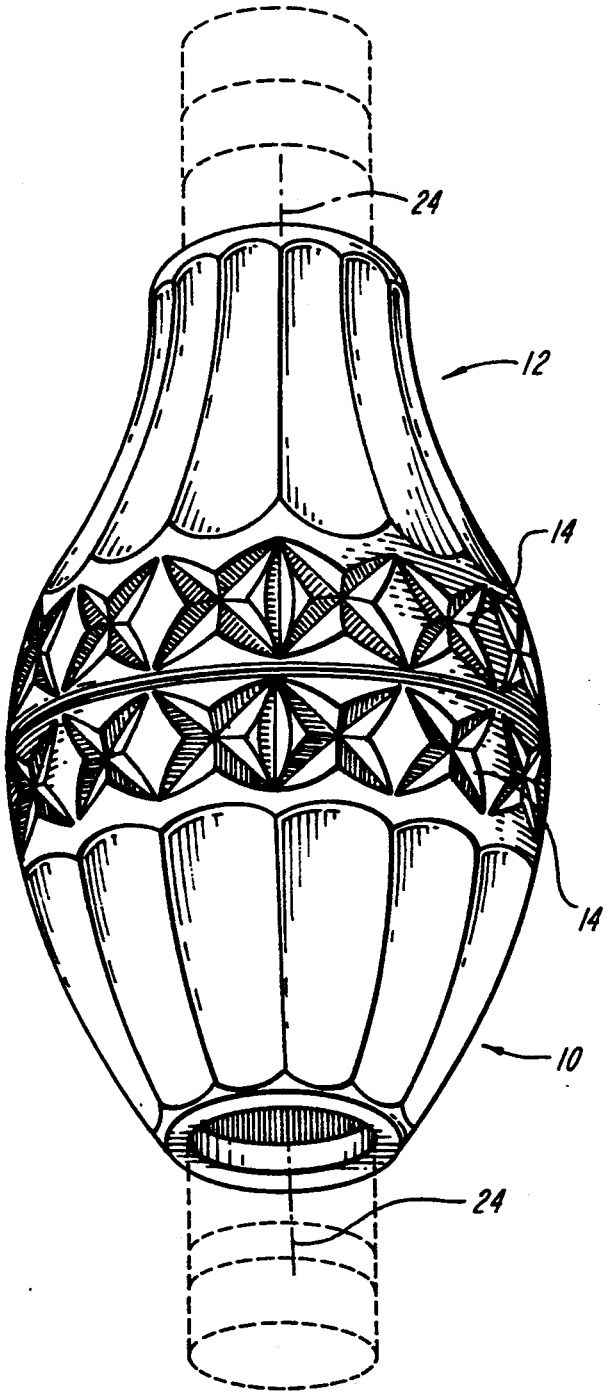
FIG. 2 is a perspective view of the two-piece glass combination of FIG. 1, the two pieces secured to one another in predetermined alignment.

FIG. 2 is a perspective view of the urn bodies 10, 12 of FIG. 1 joined in mating relationship and mounted on rod shown in phantom. As is readily seen, the stars 14 which form the elements of the decorative pattern adjacent the rims 16 are aligned with one another such that a single overall pattern is formed thereby giving the appearance of a single piece of glass. To enhance this, the edges 22 at the outer perimeters of the rims 16 are beveled to give the illusion of a circumferential cut in the glass.

The pattern may be selected to provide additional optical advantages. For example, in molding the urn bodies 10, 12, three longitudinally extending mold seams are formed, designated by dotted lines 24. These mold seams may be positioned with respect to the decorative pattern so as to optically obscure them. In the embodiment shown, the molded shapes of the decorative pattern result in apices 26 which are defined by an outwardly disposed edge of an element of the design. Placing the mold seam along such an apex optically obscures the mold seam. The molded decorative pattern also may include inwardly-directed, substantially V-shaped grooves, which if longitudinally oriented also can act to obscure mold lines. For example, design elements including grooves 28 are positioned adjacent the rims of the urn bodies and act to optically obscure the mold seams.

The projections and indentations 18, 20 also may be placed with respect to the decorative patterns to optically obscure their presence. For example, the decorative pattern may include elements having tapered ends, such as diamonds or the individual arms of the stars 14. The projections and indentations then may be placed at the points of such tapered ends, which tends to obscure their presence.

Thus, an overall appearance of a single piece of glass is created when the mating urn bodies are joined to one another by aligning the patterns of two urn bodies with respect to one another, forming the patterns in a predetermined manner with respect to the mold seams and positioning the interengaging formations with respect to the patterns.

Figure 3:
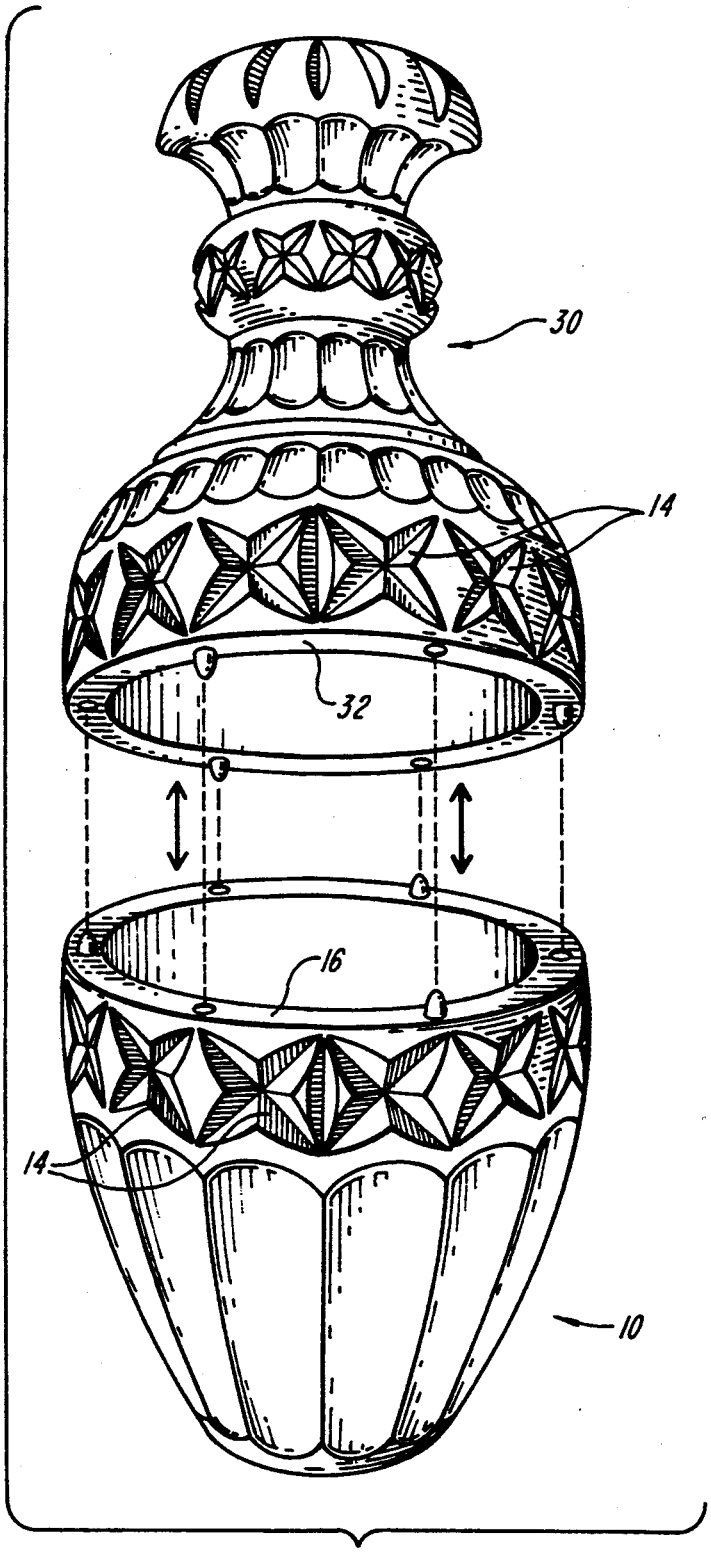
FIG. 3 is a perspective view of a second two-piece glass combination having interengaging formations aligned, but separated from one another axially.
Figure 4:
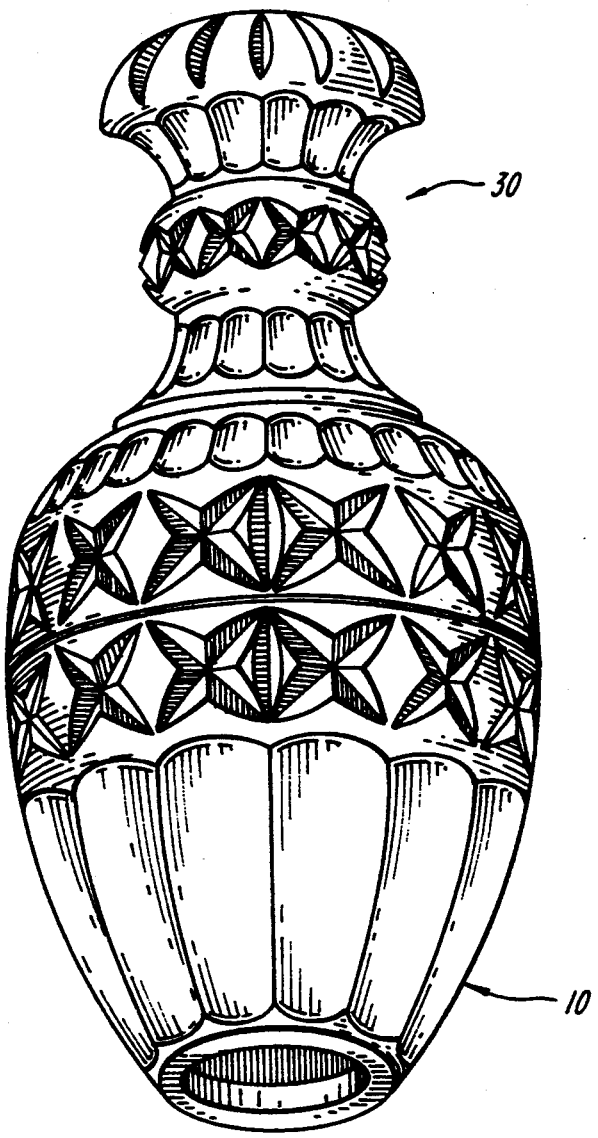
FIG. 4 is a perspective view of the two-piece glass combination of FIG. 3, the two pieces secured to one another in predetermined alignment.

FIGS. 3 and 4 illustrate another embodiment of the invention, in which the urn body 10 is coupled with a different ornament, urn cover 30. Although the overall shape and decorative pattern of urn cover 30 differs substantially from that of urn body 12, the elements of the decorative pattern adjacent the rim (stars 14) are identical to the decorative elements or stars 14 located adjacent the rim on the urn body 12. Likewise, the rim 32 of the urn cover 30 has an identical configuration to the rims 16 of the urn bodies 10, 12. Thus, it can be seen that a single urn body 10 may be used with a variety of mating ornaments to achieve a variety of overall designs.

Figure 5:
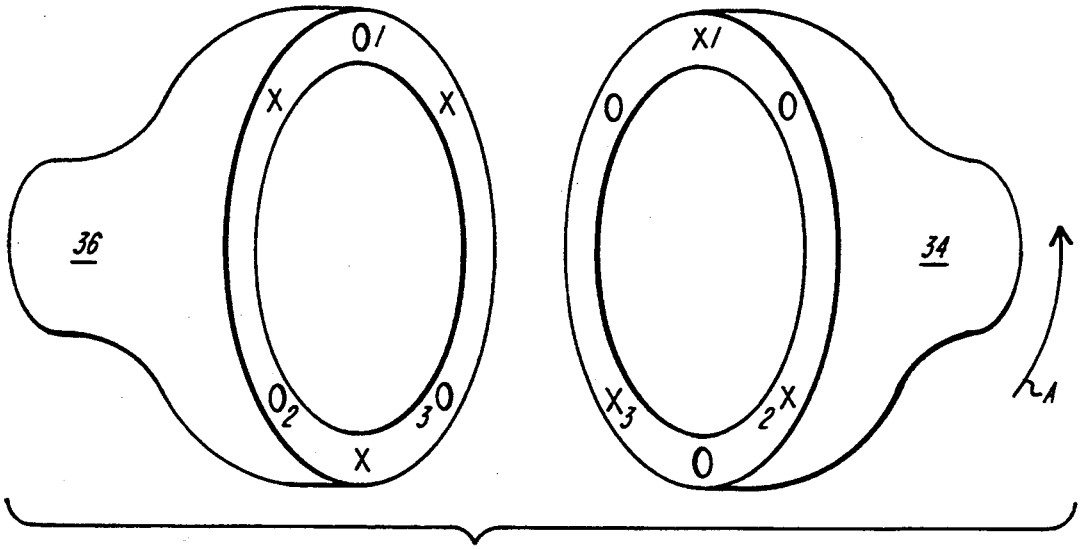
FIG. 5 is a schematic representation of a two-piece glass combination.

It will be understood by those of ordinary skill in the art that the arrangements of the projections and indentations on ornaments such as those depicted in FIGS. 1–4 can be such that only a single mating position between the two ornaments is permitted or such that many mating positions are permitted. For example, in FIGS. 1–4, there are three projections 18 on each circular rim, spaced evenly apart. This arrangement forms a geometric pattern of an equilateral triangle (the geometric pattern being the polygon defined by the straight-line connection of the projections). The indentations on the mating rim form the same geometric pattern. As will be readily understood, the ornaments then will mate at any rotational orientation where the geometric patterns are congruent (overlapping). Thus, referring to FIG. 5, in the rotational orientation depicted, X1 mates with 01, X2 with 02 and X3 with 03. If, however, ornament 34 is rotated with respect to ornament 36 by 60° in the direction of arrow A, then X2 will be capable of mating with 01, X3 with 02 and X1 with 03. Rotating ornament 34 still another 60° with respect to ornament 36 will permit yet another mating orientation.

In the preferred embodiments, the number and positioning of the interengaging formations with respect to both the ornament decorative patterns and the mold seams (three such mold seams on each ornament) is such that the same overall pattern and appearance is created at any one of the three different mating positions. Among other things, this facilitates quick and correct assembly.

Figure 6:
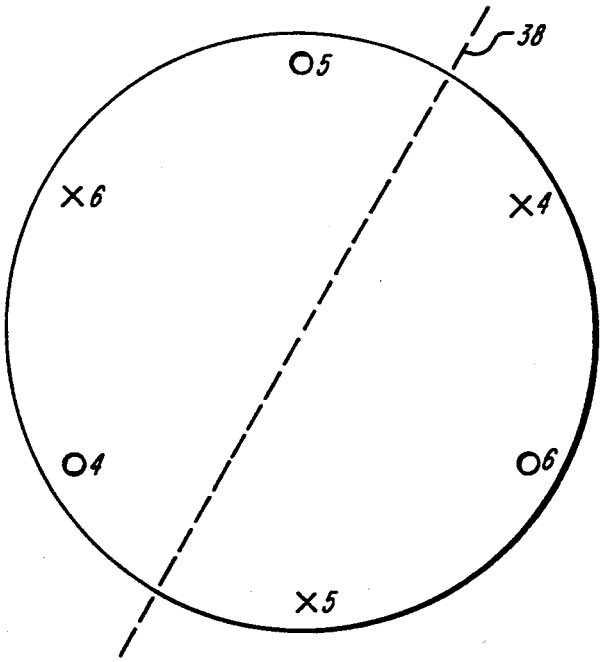
FIG. 6 is a schematic representation of the interengaging formations of one of the ornaments of FIG. 5, showing the axis of symmetry of the projections and indentations.

It also will be apparent to those of ordinary skill in the art that an advantage to the foregoing arrangement is that any one of the ornaments of FIGS. 1–4 may be secured in predetermined alignment with an identical ornament. An ornament may be secured to an identical ornament when the projections and indentations of that ornament form a geometric pattern having an axis of symmetry, with the projections and indentations being the respective geometric complement of one another about that axis of symmetry. Thus, referring to FIG. 6 which schematically depicts the geometric arrangement of the projections and indentations of each of the ornaments of FIGS. 1–4, there is an axis of symmetry indicated by dotted line 38 about which the projections and indentations are arranged. In particular, projection X4 is the geometric complement of indentation 04; X5 is the geometric complement of 05 and X6 is the geometric complement of 06.

Figure 7:
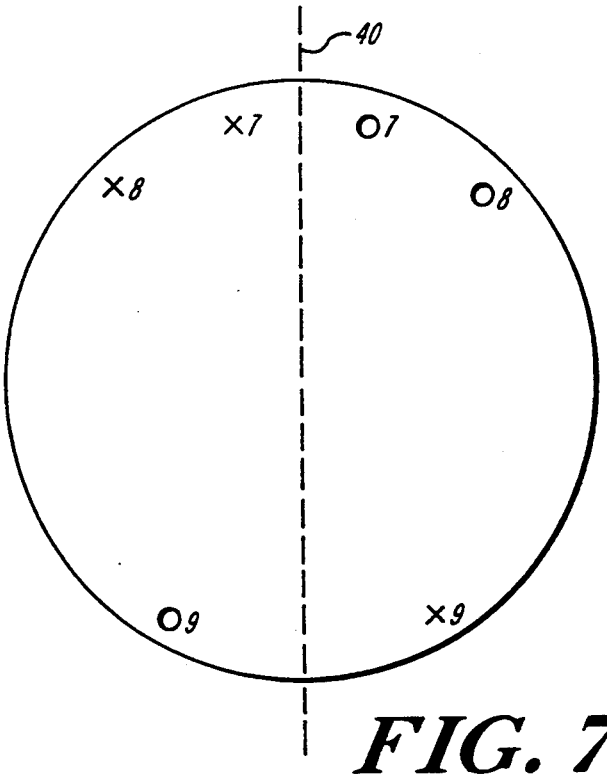
FIG. 7 is a schematic representation of another geometric configuration of interengaging formations, with the projections and indentations aligned about an axis of symmetry.
Figure 8:
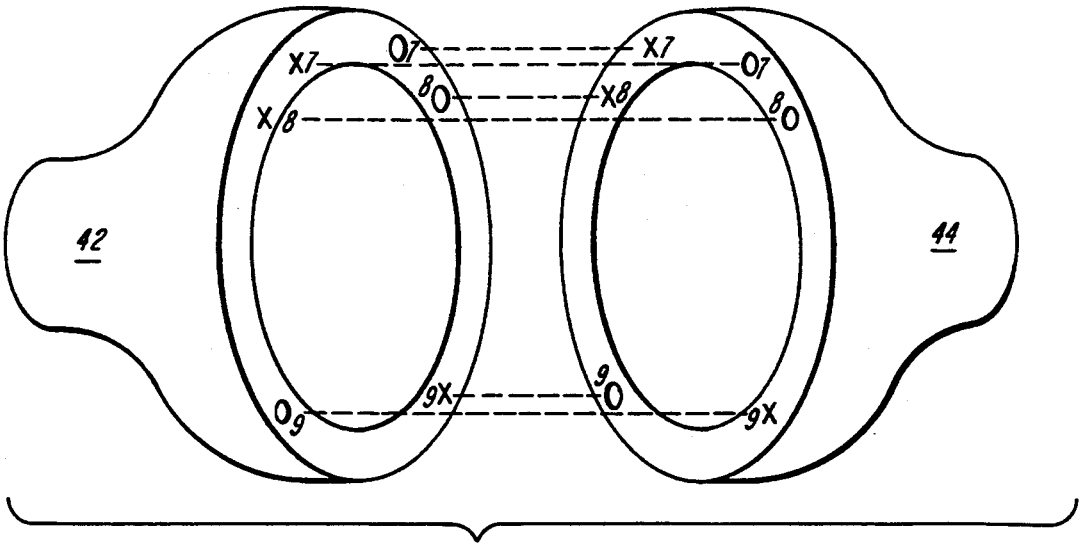
FIG. 8 is a schematic representation of a two-piece glass combination formed of identical pieces and having interengaging formations arranged as shown in FIG. 7.

FIGS. 7 and 8 show another geometric arrangement of projections and indentations that permits only a single mating orientation of identical ornaments. The axis of symmetry of the projections and indentations is indicated by dotted line 40. Projection X7 is the geometric complement of indentation 07; X8 is the geometric complement of indentation 08; and X9 is the geometric complement of indentation 09. The manner in which this geometric arrangement projections and indentations would permit the mating of identical ornaments is shown in FIG. 8. Thus, ornament 42 carries projections X7, X8 and X9 which mate with the indentations 07, 08 and 09, respectively, of ornament Likewise, projections X7, X8 and X9 of ornament 44 mate with indentations 07, 08 and 09, respectively, of ornament 42. As .can be seen, only one mating arrangement is permitted by this arrangement of projections and indentations.

Figure 9:
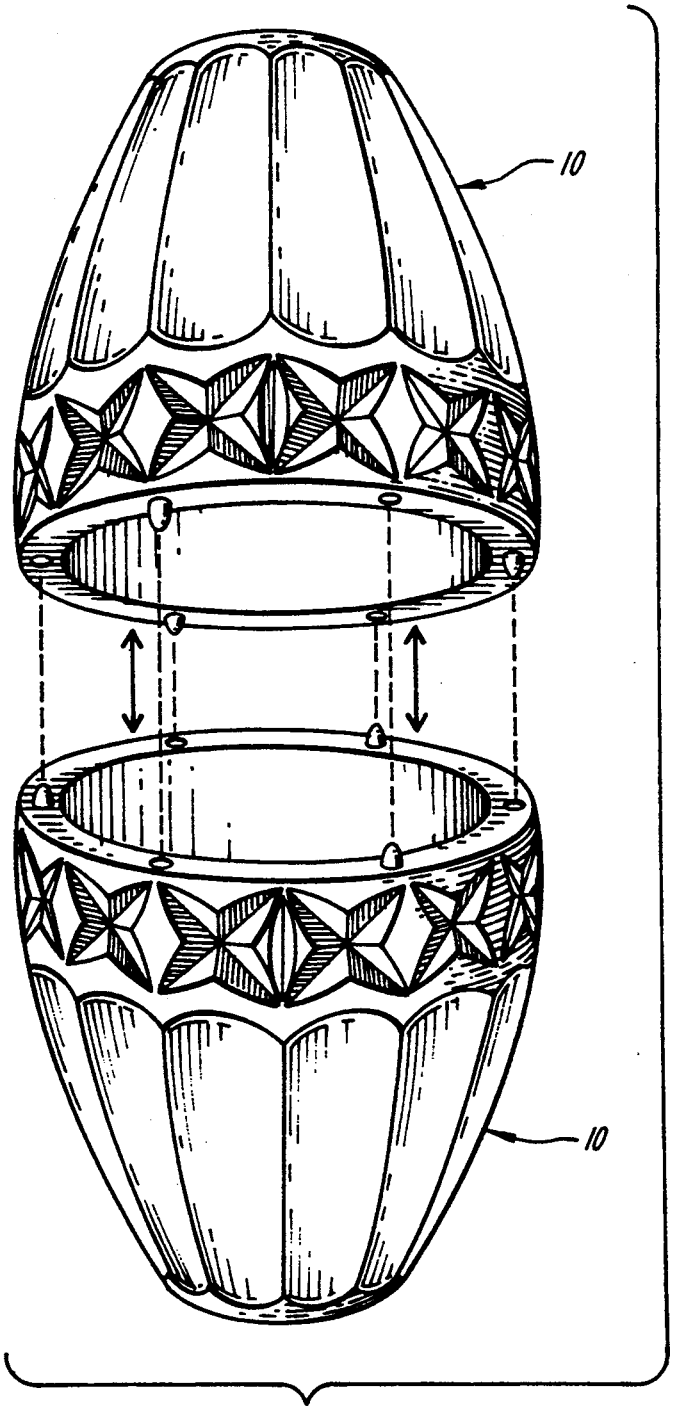
FIG. 9 is a perspective view of a third two-piece glass combination, the two pieces being identical to one another and identical to one of the pieces of FIG. 1, in predetermined alignment but axially separated.
Figure 10:
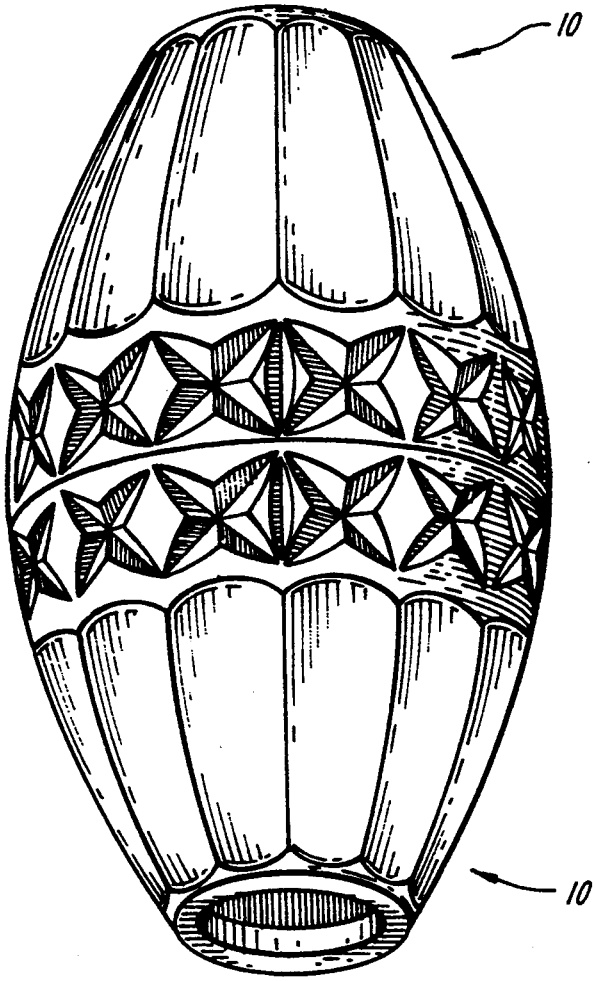
FIG. 10 is a perspective view of the two-piece glass combination of FIG. 9, the two pieces secured to one another in predetermined alignment.
Figure 11:
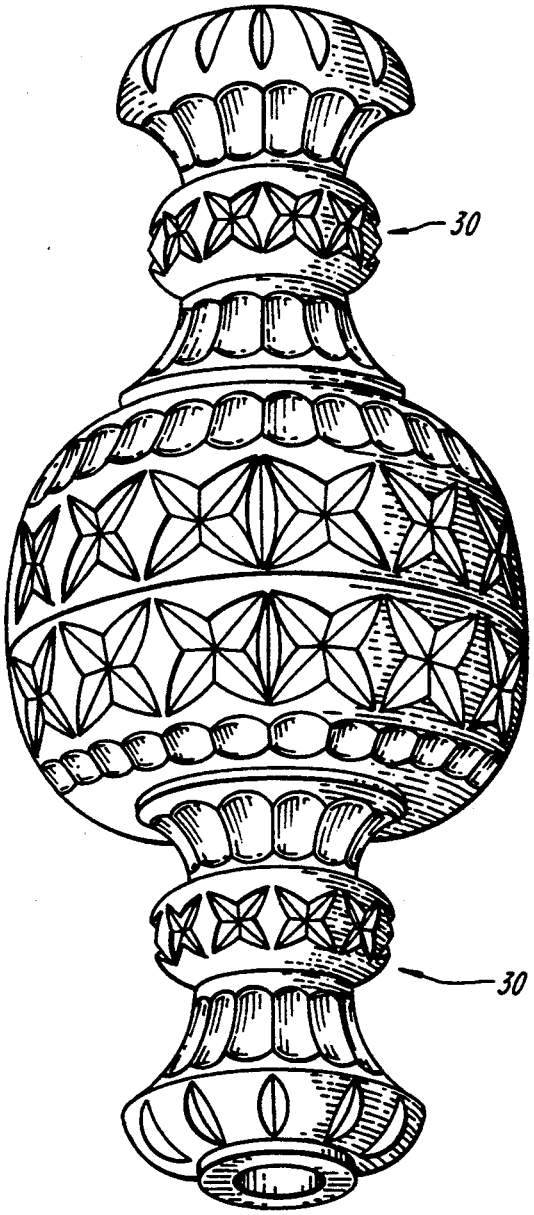
FIG. 11 is a perspective view of a fourth two-piece glass combination, the two pieces being identical to one another and to one of the pieces of FIG. 3, and secured to one another in predetermined alignment.
Figure 12:
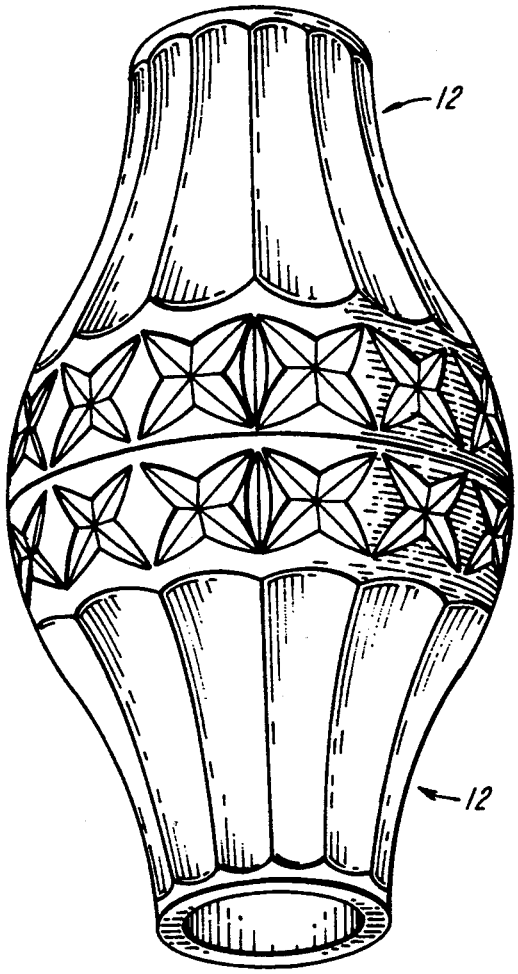
FIG. 12 is a perspective view of a fifth two-piece glass combination, the pieces being identical to one another and identical to one of the pieces of FIG. 1, and secured to one another in predetermined alignment.
Figure 13:
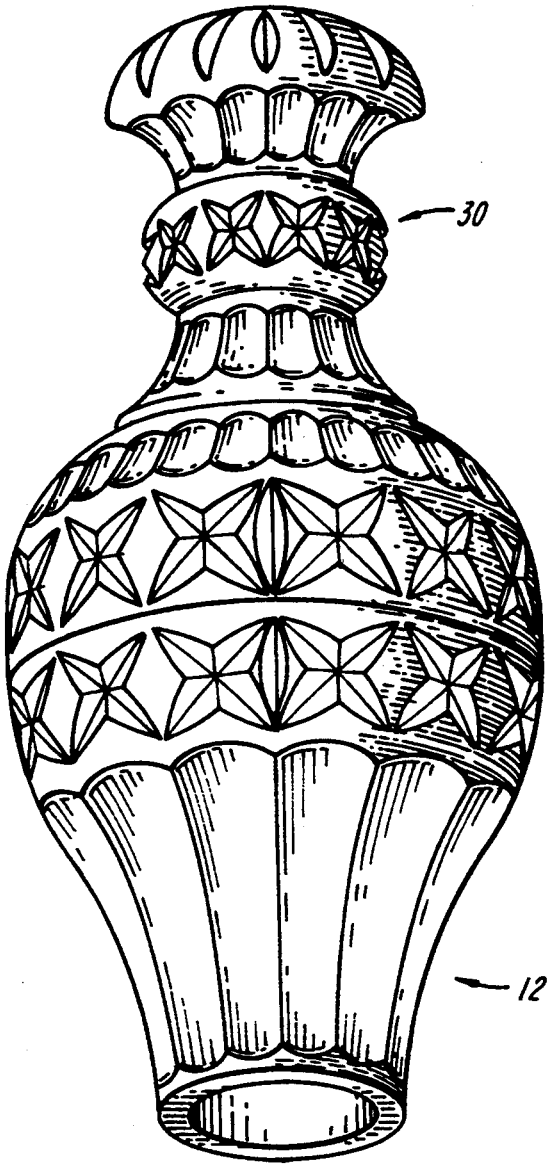
FIG. 13 is a perspective view of a sixth two-piece glass combination formed of one of the pieces of FIG. 11 and one of the pieces of FIG. 12.

Referring to FIGS. 9–12, the overall decorative patterns formed by the mating of identical ornaments such as those shown in FIGS. 1–4 are shown. In FIG. 9, a pair of urn bodies 10 are shown with decorative patterns and interengaging formations aligned, but axially separated. In FIG. 10, the urn bodies 10 are shown in mating interengagement. FIG. 11 shows the overall decorative design formed by the interengagement of a pair of identical urn covers 30. FIG. 12 shows the overall design formed by the mating interengagement of a pair of urn bodies 12. Six different overall decorative arrangements may be formed using three ornaments (urn cover 30, urn body 10 and urn body 12). The sixth decorative arrangement is shown in FIG. 13, which depicts the urn cover 30 interengaged with an urn body 12.

Figure 14:
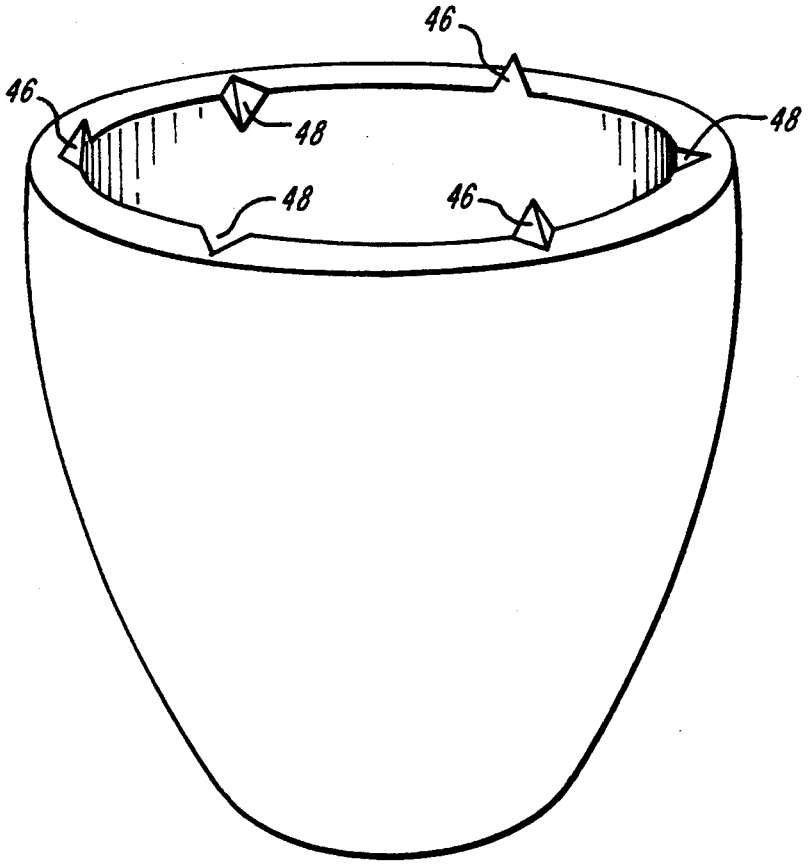
FIG. 14 is a schematic representation of another type of interengaging formation according to the invention.
Figure 15:
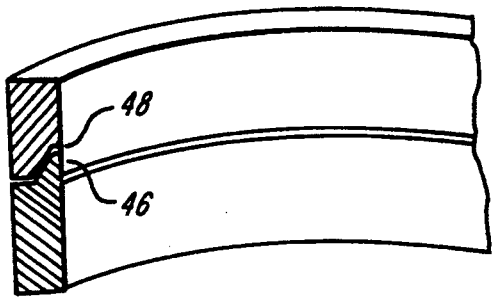
FIG. 15 is a schematic representation of a cross sectional view of the interengaging formations of FIG. 14 mating with identical interengaging formations.

It should be understood that many other arrangements of interengaging formations are possible in addition to those depicted in the preferred embodiment. For example, referring to FIGS. 14 and 15, BLUNTED HALF-PYRAMIDS 46 and V-grooves 48 are shown along the rim 50 of an ornament 52. The BLUNTED HALF-PYRAMIDS 46 and V-grooves 48 are not centered on the rim 50, but rather are located along the inner perimeter of the rim. The V-grooves 48 are formed as indentations not only in the rim, but also in the inner surface 54 of the ornament adjacent the rim 50.

It should be understood that the preceding is merely a detailed description of certain preferred embodiments. It therefore should be apparent to those skilled in the art that various modifications and equivalents can be made without departing from the spirit or scope of the invention.

What is claimed is:

1. A chandelier having rod-mounted ornaments comprising:

a chandelier frame including a rod;

a first ornament constructed from glass; and a second ornament constructed from glass, wherein the rod extends through both the first ornament and the second ornament and wherein each ornament has a rim lying substantially in a plane, the rim of the first ornament being constructed and arranged to mate in a face-to-face relationship with the rim of the second ornament when each of the first ornament and the second ornament is positioned upon the rod, each of the first ornament and the second ornament having an outer surface with a decorative pattern thereon, the decorative pattern of the first ornament capable of being aligned with the decorative pattern of the second ornament and the rim of the first ornament being secured in predetermined alignment with the rim of the second ornament whereby the decorative pattern of the first ornament is secured in predetermined alignment with the decorative pattern of the second ornament and each rim defining an outer perimeter and the rim of the first ornament being secured to the rim of the second ornament by interengaging formations disposed so as to be not visible when mated and which prevent slidable misalignment of the first ornament with respect to the second ornament, wherein the decorative pattern of each ornament is regular and repeating and each of the interengaging formations is positioned similarly with respect to the decorative pattern and wherein the decorative pattern includes tapered elements with tapered ends; proximate and tapering toward each rim and wherein each of the interengaging formations is positioned proximate one of the tapered ends.

2. A chandelier having rod-mounted ornaments comprising:

a chandelier frame including a rod;

a first ornament constructed from glass; and a second ornament constructed from glass, wherein the rod extends through both the first ornament and the second ornament and wherein each ornament has a rim lying substantially in a plane, the rim of the first ornament being constructed and arranged to mate in a face-to-face relationship with the rim of the second ornament when each of the first ornament and the second ornament is positioned upon the rod, each of the first ornament and the second ornament having an outer surface with a decorative pattern thereon, the decorative pattern of each of the first ornament and the second ornament being located proximate each rim, respectively, and the decorative pattern of the first ornament capable of being aligned with the decorative .pattern of the second ornament and the rim of the first ornament being secured in predetermined alignment with the rim of the second ornament whereby the decorative pattern of the first ornament is secured in predetermined alignment with the decorative pattern of the second ornament and each rim defining an outer perimeter and an inner perimeter and the rim of the first ornament being secured to the rim of the second ornament by projections and indentations disposed so as to be not visible when mated and which extend beyond the plane of each rim and which prevent slidable misalignment of the first ornament with respect to the second ornament.

3. A chandelier as set forth in claim 1 wherein an outer perimeter adjacent each rim is substantially congruent.

4. A chandelier as set forth in claim 1 wherein the projections and indentations are constructed and arranged to allow only one interengagement position,

5. A chandelier as set forth in claim 1 wherein the projection and indentations are constructed and arranged to allow at least three interengagement positions.

6. A chandelier as set forth in claim 1 wherein the decorative pattern of each ornament is regular and repeating.

7. A chandelier as set forth in claim 6 wherein the projection and indentations allow at least three alignment positions of the decorative pattern of the first glass ornament with respect to the second glass ornament.

8. A chandelier as set forth in claim 6 wherein each ornament includes a mold seam, wherein the decorative pattern includes an inwardly directed V-shaped groove defining a baseline and wherein the mold seam is colinear with the baseline.

9. A chandelier as set forth in claim 1 wherein each pair of the indentations and the corresponding projections is positioned relative to a respective decorative element in a manner so as to optically obscure its presence.

10. A chandelier: as set forth in claim 6 wherein each pair of the indentation and the corresponding projections is positioned similarly with respect to the decorative pattern.

11. A chandelier as set forth in claim 6 wherein each ornament includes a mold seam, wherein the decorative pattern includes an outwardly disposed apex and wherein the mold seam is positioned colinearly with the outwardly disposed apex.

12. A chandelier as set forth in any one of claims 2, 5 or 9 wherein the rim of the first ornament is secured to the rim of the second ornament by a plurality of grooves formed into both the rim and an inwardly facing wall adjoining the rim of the first ornament and a plurality of corresponding fingers projecting from the rim along an inner surface of the second ornament, the fingers being constructed and arranged to engage the grooves.

13. A chandelier as set forth in claim 2 wherein each rim has a size in width of about ½ inch whereby sufficient area is provided for locating the projections and indentations.

14. A chandelier as set forth in any one of claims 1 or 3–8 wherein the plane is disposed substantially transversely to a direction of rod extension.

15. A chandelier as claimed in claim 2 wherein the rim further comprises an outer perimeter and wherein the inner perimeter and the outer perimeter of each rim are concentric, being spaced from each other at substantially the same distance at all points thereabout.

16. A chandelier as claimed in claim 15 wherein each of the projections and indentations are located remote from each of the inner perimeter and the outer perimeter.

17. A set of at least three glass ornaments for forming multiple combinations of decorative arrangements on a chandelier having a rod comprising:

a first ornament being constructed of glass and being rod-mountable;

a second ornament being constructed of glass and being rod-mountable; and a third ornament being constructed of glass and being rod-mountable, wherein the first ornament and the second ornament are constructed and arranged to mate in predetermined alignment to form a first decorative combination, wherein the first ornament and third ornament are constructed and arranged to mate in predetermined alignment to form a second decorative combination, and wherein each of the first and the second and the first and the third ornaments are secured against misalignment by rims, each of the rims defining a plane and having projections and indentations formed on the rims and which extend remote from and beyond the plane.

18. A set of ornaments as claimed in claim 17 wherein the first, second, and third ornaments have shapes and at least two of the shapes differ.

19. A set of ornaments as claimed in claim 17 wherein the first, second and third ornaments have shapes and at least two of the shapes of the first, the second and the third ornaments are the same.

20. A set of ornaments as claimed in claim 17 wherein the first, second and third ornaments have decorative patterns and at least two of the decorative patterns differ.

21. A set of ornaments as claimed in claim 17 wherein the first, second and third-ornaments have decorative patterns and at least two of the decorative patterns of the first, second and third ornaments are the same.

22. A set of ornaments as claimed in claim 17 wherein the first, second and third ornaments have shapes and decorative patterns and wherein the respective shape and decorative pattern of one of the first, second and third ornaments is the same as the respective shape and decorative pattern of another of the first, second and third ornaments.

23. A set of ornaments as claimed in claim 17 wherein the first ornament has projections defining a geometric pattern, wherein the second ornament has indentations defining a geometric pattern, and the third ornament has indentations defining a geometric pattern, and wherein the geometric pattern defined by the projections of the first ornament is the same as the geometric pattern defined by the indentations of the second ornament and the geometric pattern defined by the indentations of the third ornament.

24. A glass ornament that is mountable on a rod, the glass ornament: having an outer surface with a decorative pattern and a rim lying in a plane, the rim having formed thereon projections and indentations located remote from , and beyond the plane, the ornament being constructed and arranged to be mounted on the rod so that a plane defined by the rim is substantially transverse to a direction of rod extension, the projections and indentations being relatively sized such that the projections are capable of being received by the indentations, the projections and indentations constructed and arranged in a pattern such that the glass ornament can be secured in predetermined alignment with an identical glass ornament that is mountable on the rod, with the rim of the glass ornament placed in face-to-face relationship with a rim of the identical glass ornament and with the projections and indentations of the glass ornament interengaged with the projections and indentations of the identical glass ornament to prevent slidable misalignment of the glass ornament with respect to the indentical glass ornament, wherein the decorative pattern of the glass ornament and the identical glass ornament are located adjacent the rim and the projections and indentations are positioned relative to the decorative pattern so that the projections and indentations are covered by .predetermined elements of the decorative pattern whereby the projections and indentations are optically obscured thereby.

25. A glass ornament as claimed in claim 24 wherein the projections of the glass ornament are arranged about an axis, and wherein the geometric pattern defined by the projections at one rotational orientation about the axis is the same as the geometric pattern defined by the projections at another rotational orientation about the axis.

26. A glass ornament as claimed in claim 24 wherein the projections and indentations form a geometric pattern having an axis of symmetry, the projections and indentations being the respective geometric complement of each other about the axis of symmetry.

27. A glass ornament that is mountable on a rod, the glass ornament having an outer surface with a decorative pattern and having a rim, the rim lying substantially in a plane, the rim having formed thereon projections and indentations, the glass ornament constructed and arranged to be mounted on the rod so that the plane defined by the rim is substantially transverse to a direction of rod extension, the projections and indentations being relatively sized such that the projections are capable of being received by the indentations, the projections and indentations constructed and arranged in a pattern such that the glass ornament can be secured in predetermined alignment with an identical glass ornament, with the rim of the glass ornament placed in face-to-face relationship with a rim of the identical glass ornament and with the projections and indentations of the glass ornament interengaged with projections and indentations of the identical glass ornament, the rim including an inner edge and an outer edge, the inner edge and the outer edge being concentric and spaced from each other at substantially the same width about an entire perimeter of the glass ornament and each of the projections and indentations being positioned on the rim remote from the inner edge and the outer edge.

28. A chandelier having rod-mounted ornaments comprising:

a chandelier frame including a rod;

a first glass ornament; and a second glass ornament, wherein the rod extends through both the first glass ornament and the second glass ornament and wherein each of the first glass ornament and the second glass ornament each includes a rim, the rim of the first glass ornament constructed and arranged to mate in a face-to-face relationship with the rim of the second glass ornament when the first glass ornament and the second glass ornament are each positioned upon the rod, each of the first glass ornament and the second glass ornament having an outer surface with a decorative pattern thereon, the decorative pattern of are of the first glass ornament and the second glass ornament capable of being aligned with the decorative pattern of another of the first glass ornament and the second glass ornament and the rim of each of the first glass ornament and the second glass ornament being secured in predetermined alignment with each other whereby the decorative pattern of the first glass ornament is secured in predetermined alignment with the decorative pattern of the second glass ornament and each rim lies substantially in a plane and defines an inner edge and an outer edge and each rim is secured to the other rim by interengaging formations positioned remote from each of the inner edge and the outer edge, the interengaging formations preventing slidable misalignment of the first glass ornament with respect to the second glass ornament, the decorative pattern of at least one of the first glass ornament and the second glass ornament being regular and repeating and being located so that at least a portion of the decorative pattern is positioned substantially adjacent the rim of at least one of the first glass ornament and the second glass ornament, the interengaging formations being located so as to be optically obscured by the portion of the decorative pattern on at least one of the first glass ornament and the second glass ornament.

29. A chandelier as claimed in claim 28 wherein the interengaging formations comprise projections and indentations, the projections being constructed and arranged to be received by the indentations.

30. A chandelier as claimed in claim 28 wherein the inner edge and the outer edge of the rim of each of the first glass ornament and the second glass ornament are concentric and are spaced from each other at a distance that is substantially equal about an entire perimeter of each of the first glass ornament and the second glass ornament, respectively.

31. A set of at least three glass ornaments for forming multiple combinations of decorative arrangements on a chandelier having a rod comprising:

a first rod-mountable glass ornament;

a second rod-mountable glass ornament; and a third rod-mountable glass ornament, wherein the first rod-mountable glass ornament and the second rod-mountable glass ornament are constructed and arranged to mate in predetermined alignment to form a first decorative combination, wherein the first rod-mountable glass ornament and the third rod-mountable glass ornament are constructed and arranged to mate in predetermined alignment to form a second decorative combination, and wherein each of the first rod-mountable glass ornament and the second rod-mountable glass ornament and the first rod-mountable glass ornament and the third rod-mountable glass ornament are secured against misalignment by respective rims mating in a face-to-face relationship, the respective rims each having an inner edge and an outer edge and the respective rims having interengaging formations positioned remote from each inner and outer edge, wherein the inner edge and the outer edge of each of the respective rims are concentric and spaced from each other a substantially equal distance about an entire perimeter of each of the respective rims.

32. A set as claimed in claim 31 wherein the interengaging formations comprise projections and indentations, the projections being constructed and arranged to be received by the indentations.

33. A set as claimed in claim 32 wherein the first rod-mountable glass ornament, second rod-mountable glass ornament and third rod-mountable glass ornament each include a decorative pattern thereon located adjacent each rim and wherein the projections and indentations are located so that at least a portion of the decorative pattern optically obscures the projections and indentations.

34. A chandelier having rod-mounted ornaments comprising:

a chandelier frame including a rod;

a first ornament constructed from glass; and a second ornament constructed from glass, wherein the rod extends through both the first ornament and the second ornament and wherein each ornament has a rim lying substantially in a plane, the rim of the first ornament being constructed and arranged to mate in a face-to-face relationship with the rim of the second ornament when each of the first ornament and the second ornament is positioned upon the rod, the first ornament having an outer surface with a decorative pattern thereon, the decorative pattern of each of the first ornament and the second ornament capable of being aligned with the decorative pattern of the second ornament and the rim of the first ornament being secured in predetermined alignment with the rim of the second ornament whereby the decorative pattern of the first ornament is secured in predetermined alignment with the decorative pattern of the second ornament and each rim defining an outer perimeter and the rim of the first ornament being secured to the rim of the second ornament by interengaging formations disposed so as to be not visible when mated and which prevent slidable misalignment of the first ornament with respect to the second ornament, wherein the rim of the first ornament is secured to the rim of the second ornament by a plurality of grooves formed into both the rim and an inwardly facing wall adjoining the rim of the first ornament and a plurality of corresponding fingers projecting from the rim along an inner surface of the second ornament, the fingers being constructed and arranged to engage the grooves.

* * * * *